US010559436B2

(12) United States Patent
Chien et al.

(10) Patent No.: US 10,559,436 B2
(45) **Date of Patent: *Feb. 11, 2020**

(54) KEYFRAME MODULE FOR AN INPUT DEVICE

(71) Applicant: Logitech Europe S.A., Lausanne (CH)

(72) Inventors: Linus Chien, Zhubei (TW); Chia Feng Lee, Taichung (TW)

(73) Assignee: Logitech Europe S.A., Lausanne (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/881,363

(22) Filed: Jan. 26, 2018

(65) Prior Publication Data

US 2018/0151314 A1 May 31, 2018

Related U.S. Application Data

(63) Continuation of application No. 14/747,402, filed on Jun. 23, 2015, now Pat. No. 9,911,554.

(51) Int. Cl.
*H01H 13/70* (2006.01)

(52) U.S. Cl.
CPC ... *H01H 13/7013* (2013.01); *H01H 2205/004* (2013.01); *H01H 2215/008* (2013.01); *H01H 2221/058* (2013.01); *H01H 2223/034* (2013.01); *H01H 2227/036* (2013.01); *H01H 2231/002* (2013.01)

(58) Field of Classification Search
CPC ..... H01H 13/88; H01H 2205/004; H01H 13/7013; H05K 999/99
USPC ..... 200/5 A
See application file for complete search history.

(56) References Cited

U.S. PATENT DOCUMENTS 4,439,646 A 3/1984 Bouvrande et al.
5,193,669 A * 3/1993 Demeo ..... H01H 13/7006 200/302.2
9,911,554 B2 * 3/2018 Chien ..... H01H 13/7013
(Continued)

OTHER PUBLICATIONS

Final Office Action for U.S. Appl. No. 14/747,402 dated Jun. 30, 2017, 11 pages.

(Continued)

*Primary Examiner* — Edwin A. Leon
*Assistant Examiner* — Iman Malakooti
(74) *Attorney, Agent, or Firm* — Kilpatrick Townsend & Stockton LLP

(57) ABSTRACT

System and methods for providing a keyframe module for a input device are disclosed. In an embodiment, the input device includes a keyframe having a key opening, and a key disposed within the key opening. The key includes a keycap having a bottom surface, a plurality of tabs that extend laterally from the bottom surface of the keycap, and a protrusion extending from the bottom surface of the keycap. A compressible dome structure is disposed underneath the protrusion, and a plate is coupled to the keyframe and disposed underneath the compressible dome structure. A plurality of openings is disposed within the plate, where a location of the plurality of openings corresponds to a location of the plurality of tabs such that one or more of the plurality of tabs pass through one or more of the plurality of openings in response to the depression of the key.

17 Claims, 8 Drawing Sheets

(56) References Cited

U.S. PATENT DOCUMENTS

| | | | | |
|---|---|---|---|---|
| 2014/0034472 | A1* | 2/2014 | Krumpelman | H01H 13/70 200/5 A |
| 2016/0049266 | A1* | 2/2016 | Stringer | H01H 13/704 200/5 A |
| 2016/0379774 | A1 | 12/2016 | Chien et al. | |

OTHER PUBLICATIONS

Non Final Office Action for U.S. Appl. No. 14/747,402 dated Dec. 30, 2016, 12 pages.
Notice of Allowance for U.S. Appl. No. 14/747,402 dated Oct. 26, 2017, 9 pages.

* cited by examiner

KEYFRAME MODULE FOR AN INPUT DEVICE

This application is a continuation of U.S. application Ser. No. 14/747,402 entitled "KEYFRAME MODULE FOR AN INPUT DEVICE" filed Jun. 23, 2015, which is herein incorporated by reference in its entirety for all purposes.

BACKGROUND

The present disclosure relates in general to input devices, and in particular to keyframe modules for keyboard devices.

Modern tablet computers are valuable assets for consumers today. Not only do they have the ability to perform day-to-day computer functions, such as e-mailing, word processing, and Web browsing, but they also have a compact size for increased portability. Modern tablet computers include virtual keyboards; however, such virtual keyboards are often difficult to use and/or difficult to grow accustomed to. Thus, tablet accessories, such as portable keyboards, have been developed to accommodate customers who prefer the touch and feel of a physical keyboard. Improvements to the portability of such keyboards prove challenging, given the size constraints of current keyboard design.

SUMMARY

Embodiments of the present invention are directed to a keyframe module for an input device. In certain embodiments, the keyframe module includes a keycap having tabs that extend laterally from a bottom of the keycap. A plate is located below the keycap and includes openings in locations corresponding to the tabs. At least some of the tabs may press into respective openings when the key is depressed. Such configurations result in an input device having a lower profile design. Having a lower profile design allows the input device to have a more compact footprint, and thus be more portable. Additionally, such configurations result in a more ergonomic input device by allowing effectuation of a key press just as easily at the edge than at the center of the keycap.

In certain embodiments, an input device includes a keyframe having a key opening, and a key disposed within the key opening. The key includes a keycap having a top surface and a bottom surface, a plurality of tabs that extend laterally from the bottom surface of the keycap, and a protrusion extending from the bottom surface of the keycap, where the protrusion extends at an angle normal to the bottom surface of the keycap. The input device includes a compressible dome structure disposed underneath the protrusion of the keycap, where the protrusion depresses the compressible dome structure in response to a depression of the keycap when the key is in a depressed state. The input device further includes a plate coupled to the keyframe and disposed underneath the compressible dome structure, where a plurality of openings is disposed within the plate, and where a location of the plurality of openings corresponds to a location of the plurality of tabs such that one or more of the plurality of tabs pass through one or more of the plurality of openings in response to the depression of the key when the key is in a depressed state.

In some embodiments, the compressible dome makes contact with the protrusion. The compressible dome structure may contact the protrusion and cause the plurality of tabs to press up against a bottom of the keyframe when the key is in a non-depressed state. In embodiments, a portion of the keyframe makes contact with the plurality of tabs to prevent further upward vertical movement of the tabs. The plurality of tabs may be disposed at corners of the keycap. In embodiments, the plurality of tabs and the keycap form one monolithic structure. In some embodiments, the compressible dome structure is coupled to the plate. The input device may further include a membrane disposed between the plate and the compressible dome structure. The membrane may be electrically coupled to the compressible dome structure. In some embodiments, the membrane comprises a plurality of electrical routing lines to electrically couple the compressible dome structure with an external device. The compressible dome structure may be formed of metal.

In certain embodiments, a method of forming a keyboard includes forming a subassembly comprising a dome sheet and a membrane attached to the dome sheet, placing a keyframe onto a keyboard positioning fixture, and placing an array of keys into respective openings of the keyframe, the array of keys comprising a plurality of tabs on a bottom surface of the keys. The method includes placing the subassembly onto the array of keys and keyframe, where the dome sheet comprises an array of compressible dome structures that make contact with protrusions disposed on the bottom surface of the keys. The method further includes placing a plate onto the subassembly to couple the plate to the keyframe, where the plate comprises a plurality of openings, where a location of the plurality of openings corresponds to a location of the plurality of tabs such that one or more of the plurality of tabs pass through one or more of the plurality of openings in response to a depression of the key when the key is in a depressed state. The method includes removing the keyboard from the keyboard positioning fixture.

In some embodiments, forming the subassembly includes placing the membrane onto a subassembly positioning fixture, attaching the dome sheet to the membrane, and removing the dome sheet and membrane from the subassembly positioning fixture. The dome sheet may be attached to the membrane with an adhesive. In embodiments, the method further includes placing an insulating film onto the subassembly prior to placing the plate.

In certain embodiments, a key includes a keycap having a top surface and a bottom surface, a plurality of tabs that extend laterally from the bottom surface of the keycap, and a protrusion extending from the bottom surface of the keycap, where the protrusion extends at an angle normal to the bottom surface of the keycap, and where the protrusion depresses a compressible dome structure in response to a depression of the keycap when the key is in a depressed state.

In some embodiments, the plurality of tabs makes contact with portions of the keyframe. The tab and the keycap may form one monolithic structure. In embodiments, each tab has dimensions smaller than a respective opening disposed directly below the tab, a location of the opening corresponds to a location of the tab such that the tab passes through the opening in response to a depression of the key when the key is in a depressed state.

DETAILED DESCRIPTION

In the following description, numerous examples and details are set forth in order to provide an understanding of embodiments of the present invention. It will be evident to one skilled in the art, however, that certain embodiments can be practiced without some of these details, or can be practiced with modifications or equivalents thereof.

An important aspect of a keyboard is the way it feels when used. A keyboard that achieves good feel has keys that effectuate a key press when pressure is applied to any portion of the top of the key. To achieve good feel, conventional keyboards utilize scissor keys. Scissor keys include a mechanical actuator that activates like a scissor when the key is depressed. The design of the mechanical actuator allows a user to effectuate a key press just as easily at the edge than at the center of the keycap.

Although scissor keys provide good feel during use, the resulting keyboard is large and bulky, which is not desirable for compact devices. To address this size issue, conventional keyboards have implemented a dome key that utilizes a dome structure. By replacing the mechanical actuator of the scissor key with that of the dome structure, the size of the key is significantly reduced. The dome structure collapses when a keycap is depressed to effectuate a key press. What the dome key gains in its small size, however, it lacks in its feel when used. Because the dome structure is disposed beneath the center of the keycap, pressure applied at the edges of the keycap require more force to effectuate a key press than the center of the key. Accordingly, conventional dome keys do not feel as good as conventional scissor keys and do not allow a user to effectuate a key press just as easily at the edge than at the center of the keycap.

Figure 1:
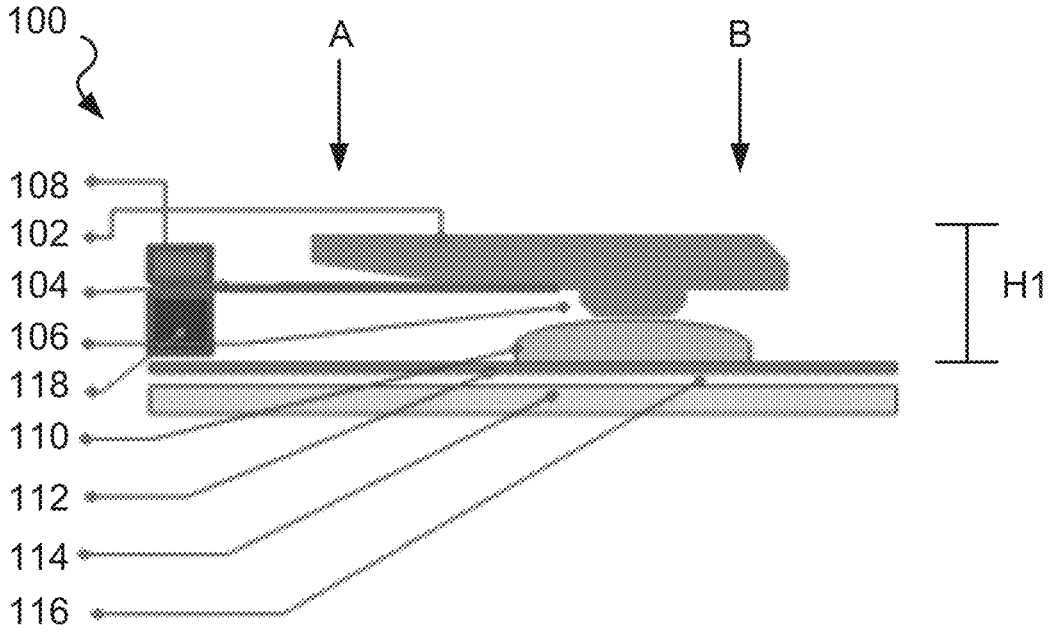
FIG. 1 is a simplified diagram illustrating a cross-sectional view of a keyframe module.

FIG. 1 illustrates such a keyframe module of an input device. For instance, the keyframe module may be a key 100, and the input device may be a keyboard for a computer. The key 100 includes a keycap 102 and a protrusion 106. The keycap 102 is physically attached to the keyframe 108 by a hinge 104. The hinge 104 may be any suitable hinge that allows the keycap 102 to move downward, such as a mylar hinge. The hinge 104 may be coupled to an actuator 118 that allows the hinge 104 to move when the keycap 102 is depressed. The key 100 also includes a dome structure 110 disposed below the protrusion 106. The dome structure 110 may be a compressible dome structure that is coupled to a plate 114. In some embodiments, a membrane 112 and an insulating film 116 may be disposed between the dome structure 110 and the plate 114. The key 100 effectuates a key press when a force, e.g., a force applied by a user, is applied downwards onto the keycap 102, causing the hinge 104 to actuate and move the keycap 102 downwards. The downward-moving keycap 102 causes the protrusion 106 to depress and compress the dome structure 110. When the dome structure 110 is compressed, the key press is effectuated. Effectuation of the key press may result in an input corresponding to the key 100 being received by an external device, such as a computer.

The configuration of key 100 illustrated in FIG. 1 may have a height H1 of at least 3.2 mm. The height of the key 100 may be necessitated by the clearance needed for the actuator 118 to function properly. Having height H1 causes the input device to be bulkier and less portable. Additionally, the hinge 104 may cause the key 100 to require different amounts of force to effectuate a key press. For instance, a force applied at location A of the keycap 102 needs to be greater than the force applied at location B. This is because actuation of the hinge 104 requires application of a rotational force. In order to effectuate a depression of the key 100, a force applied closer to the fulcrum (i.e., near the actuator 106) needs to be greater than the force applied farther away from the fulcrum. This inconsistency may lead to user discomfort, as well as premature fatigue associated with using the key 100.

Structure of the Keyframe Module

Embodiments of the present invention provide systems and methods for a keyframe module of an input device that has both small size and good feel. The keyframe module includes a keycap having tabs that may press into openings in a plate disposed underneath the keycap, and/or press up upon a bottom surface of a keyframe when the keycap is depressed. The tabs work in combination with the openings and the keyframe during depression of the key to allow the keyframe module to have a low, compact profile, and allow the keyframe module to effectuate a key press just as easily at the edge than at the center of the keycap.

Figure 2:
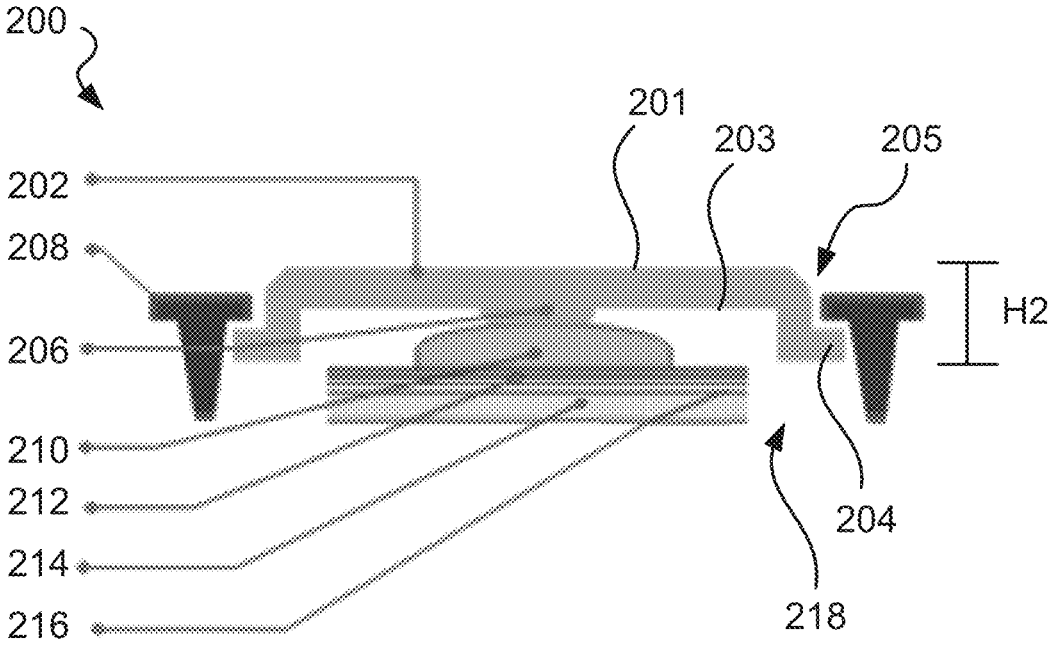
FIG. 2 is a simplified diagram illustrating a cross-sectional view of a keyframe module, in accordance with certain embodiments of the present invention.

FIG. 2 illustrates a keyframe module, i.e., key 200, in a non-depressed state, according to certain embodiments of the present invention. The key 200 may include a keycap 202 and a keyframe 208. The keyframe 208 may have a key opening 205 within which the keycap 202 may be disposed. The key opening 205 may be delineated by the structure of the keyframe 208. In embodiments, the keycap 202 has a top surface 201 and a bottom surface 203. The top surface 201 may be a substantially planar surface to allow an object, such a user's finger, to apply a downward force on the keycap 202 to effectuate a key press.

According to embodiments of the present invention, several tabs 204 are disposed on the bottom surface 203 of the keycap 202. In embodiments, the tabs 204 and the keycap 202 form one monolithic structure. The tabs 204 may extend laterally from the bottom surface 203 of the keycap 202 such that the tabs 204 extend underneath a portion of the keyframe 208. The tabs 204 prevent the keycap 202 from moving upward when the tabs 204 make contact with the keyframe 208 in a non-depressed state and during application of a force on the keycap 202 to effectuate a key press in a depressed state, as will be discussed further herein with respect to FIGS. 6A-6C.

A protrusion 206 may be disposed on the bottom surface 203 of the keycap 202 to make contact with a dome structure 210. In certain embodiments, the protrusion 206 extends away from the bottom surface 203 toward the dome structure 210. For instance, the protrusion 206 may extend at an angle normal to the bottom surface 203 of the keycap 202.

The dome structure 210 may be a compressible dome structure that is coupled to a plate 214. The compressible dome structure 210 may be disposed underneath the protrusion 206 to allow the protrusion 206 to compress the dome structure 210 when effectuating a key press, e.g., when the key 200 is in a depressed state. Additionally, the compressible dome structure 210 may support the keycap 202 when the key 200 is not being depressed to effectuate a key press, e.g., when the key 200 is in a non-depressed state. Accordingly, the keycap 202 may merely rest on the compressible dome structure 210 and not be attached to any structure by any form of fastening mechanism. Effectuation of a key press may occur when the compressible dome structure 210 is compressed. Collapsing the compressible dome structure 210 may cause a portion of the dome structure to complete a circuit in the membrane 212 and cause a signal to be routed to an external device, such as a computer. For example, collapsing the dome structure may cause a portion of the dome structure to make electrical contact with a region of an open circuit such that the open circuit becomes closed when the contact is made.

In certain embodiments, the compressible dome structure 210 is formed of a conductive material, such as a metal. The plate 214 may be formed of any rigid material suitable to provide structural support for the key 200 during use. For instance, the plate 214 may be formed of a metal. In embodiments, the compressible dome structure 210 and the plate 214 are both formed of aluminum.

In some embodiments, a membrane 212 may be disposed between the plate 214 and the compressible dome structure 210. The membrane 212 may be a layer that includes a plurality of electrical routing lines to electrically couple the compressible dome structure 210 to an external device, such as a computer. In such instances, the membrane 212 may be electrically coupled to the compressible dome structure 210. In embodiments, an insulating film 216 is disposed between the membrane 212 and the plate 214. The insulating film 216 may be formed of any suitable insulating material for dampening sound. For instance, the insulating film 216 may be formed of a thermoplastic polyurethane (TPU) film.

According to embodiments of the present invention, the membrane 212, insulating film 216, and the plate 214 have openings 218. The openings 218 may be disposed directly below the tabs 204 to allow at least one of the tabs 204 to press into the openings 218 during effectuation of a key press. In some embodiments, the openings 218 extend through the entire thickness of plate 214 as shown in FIG. 2. However, in alternative embodiments, the openings 218 may not extend through the entire thickness of the plate 214, but may be trenches that have a cavity deep enough to allow the tabs 204 to travel below a top surface of the plate 214 to effectuate a key press. Positioning of the openings 218 is better shown in the perspective views of the key 200 illustrated in FIGS. 3 and 4.

Figure 4:
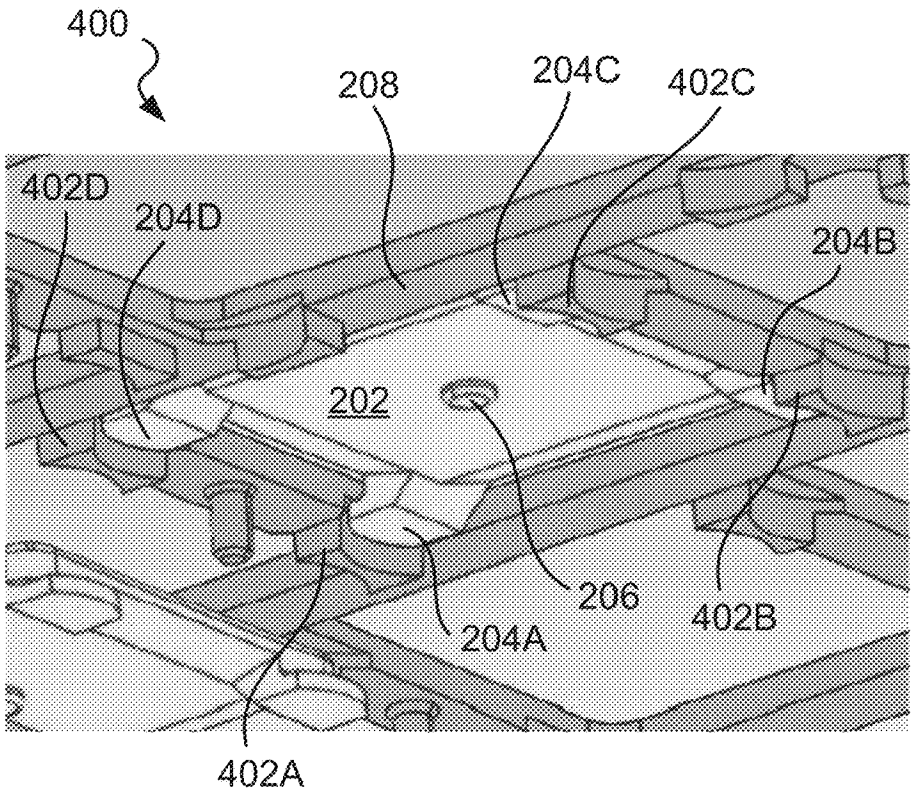
FIG. 4 is a simplified diagram illustrating a bottom perspective view of a keyframe module, in accordance with certain embodiments of the present invention.
Figure 3:
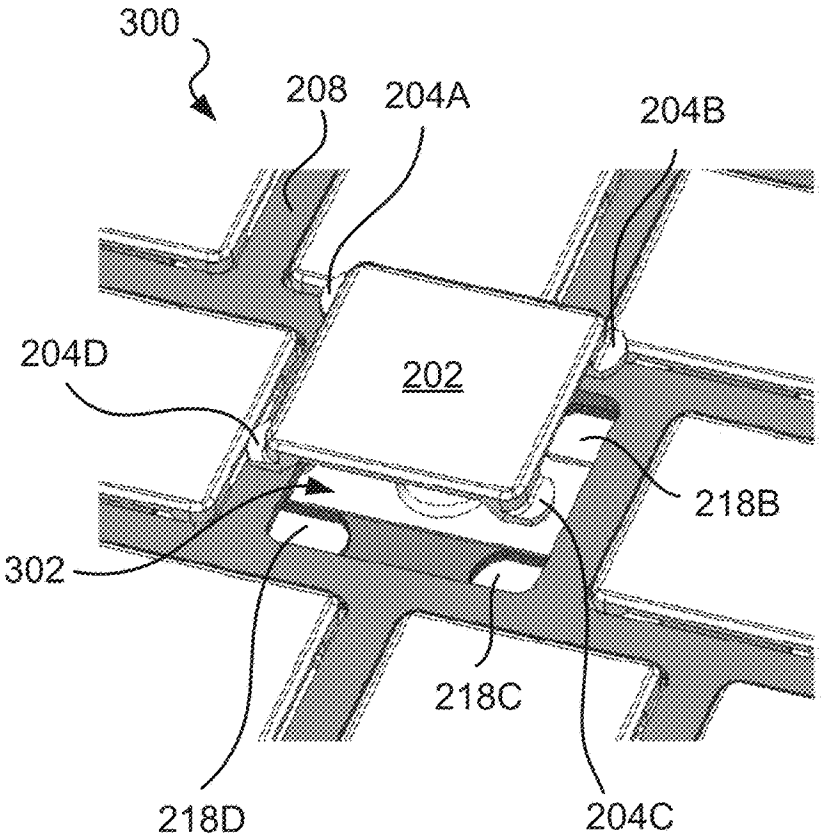
FIG. 3 is a simplified diagram illustrating a top perspective view of a keyframe module, in accordance with certain embodiments of the present invention.

FIGS. 3 and 4 illustrate perspective views of a portion of an input device. According to embodiments of the present invention, the input device is a keyboard having keys 200. Specifically, FIG. 3 illustrates a top perspective view of keys 200, and FIG. 4 illustrates a bottom perspective view of keys 200.

As shown in FIG. 3, the tabs 204 may be composed of four tabs 204A-204D that are located at the four corners of the keycap 202. The tabs 204A-204D may extend laterally from the keycap 202 in a horizontal configuration, e.g. extending toward keys to the left and right of the key 200. However, embodiments of the present invention are not limited to such configurations. For instance, the tabs 204A-204D may extend laterally from the keycap 202 in a vertical configuration, e.g. extending toward rows above and below the key 200. In embodiments, the tabs 204A-204D are disposed directly above respective openings 218A-218D.

The tabs 204A-204D may make contact with portions of the keyframe 208, as shown in FIG. 4. For example, portions 402A-402D of the keyframe 208 may make contact with tabs 204A-204D, respectively. Portions 402A-402D may include regions of a bottom surface of the keyframe 208, and downward-extending protrusions of the bottom surface of the keyframe 208. The portions 402A-402D may have contours that complement the structural contours of the tabs 204. In embodiments, the downward-extending protrusions of portions 402A-402D prevent lateral movement of the keycap 202.

Although embodiments discussed herein illustrate the tabs 204 being formed of four individual tabs, it is to be appreciated that any configuration of the tabs 204 that allow functioning of the key according to embodiments of the present invention are envisioned herein. For instance, instead of four individual tabs 204A-204D, the tabs may be formed of more or less than four tabs. In certain embodiments, the tabs are formed of one tab that wraps around the entire keycap 202. In such embodiments, the opening 218 may also be formed as a rectangular ring shape to complement such a tab design.

With brief reference back to FIG. 2, the configuration of key 200 may have a height H2 of less than 3.2 mm. For instance, the key 200 may have a height H2 of approximately 2.6 mm. The design of the keycap 202 and openings 218, allow the key 200 to have a lower profile than the design discussed herein with respect to FIG. 1. Specifically, the design of the key in FIG. 1 included a hinge 104 and an actuator 118 that required a specific height clearance. The design according to embodiments of the present invention do not require use of an intermediate structure, such as a hinge, or an actuator, because the keycap 202 is designed to rest directly on the dome structure. Thus, the height H2 may be smaller than the height H1. Having a low profile enables the input device to be less bulky and more portable. Additionally, the interaction of the tabs 204 with the openings 218 enables the key 200 to effectuate a key press with the same amount of force regardless of where the force is applied against the keycap 202, as discussed herein with respect to FIGS. 5 and 6A-6C.

Operation of the Keyframe Module

Figure 5:
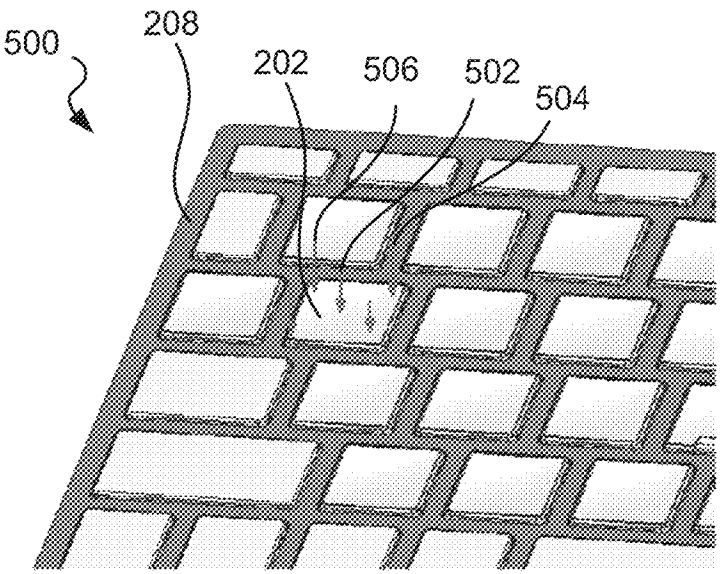
FIG. 5 is a simplified diagram illustrating a top perspective view of a keyframe module that indicates where force may be applied upon a keycap, in accordance with certain embodiments of the present invention.

FIG. 5 illustrates a perspective view of the input device having the key 200 that shows where downward forces may be applied upon keycap 202 to effectuate a key press. For instance, forces may be applied at the center of the keycap 202 as indicated by the center arrow 502. Additionally, forces may be applied at the edges of the keycap 202 as indicated by the arrows 504 and 506 at the corners of the keycap 202. According to embodiments, the same amount of force can be applied at any location on the keycap 202 to effectuate a key press. For example, an amount of force required to effectuate a key press at the center 502 of the keycap 202 may be the same amount of force required to effectuate a key press at the edge 504 or 506 of the keycap 202. This is in contrast to the different amounts of force required to effectuate a key press at an edge (e.g., edge A) of keycap 102 closest to the actuator 118 and an edge (e.g., edge B) of keycap 102 farthest away from the actuator 118, as aforementioned herein with respect to FIG. 1. Enabling effectuation of a key press with the same amount of force across the keycap 202 increases user comfort, as well as minimizes premature fatigue when the input device is used.

Figure 6A:
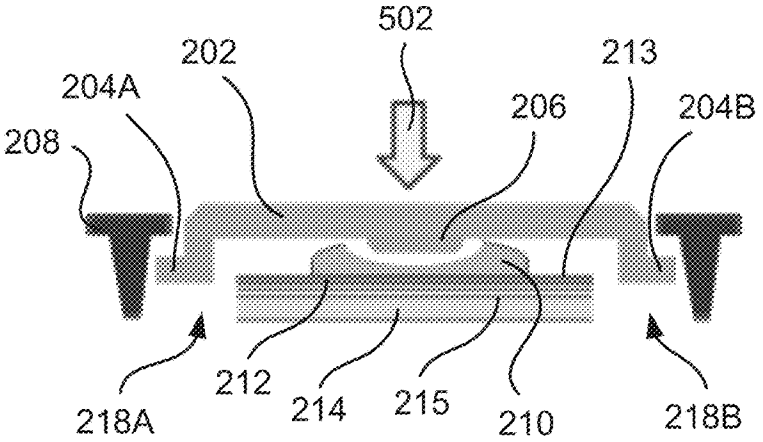
FIGS. 6A-6C are simplified diagrams illustrating cross-sectional views of the operation of the keyframe module when force is applied to effectuate a key press, in accordance with certain embodiments of the present invention.
Figure 6C:
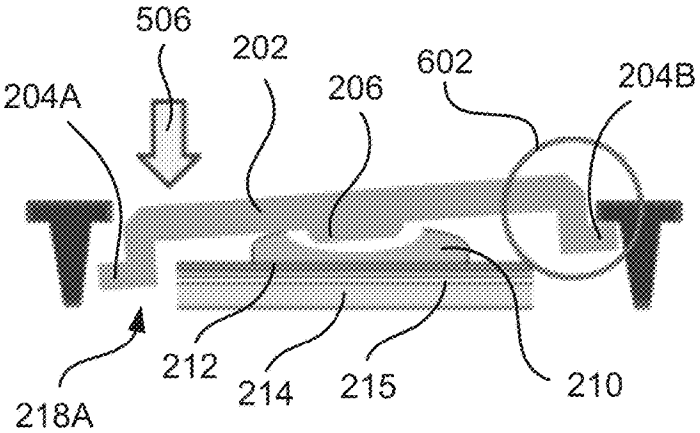
Figure 6B:
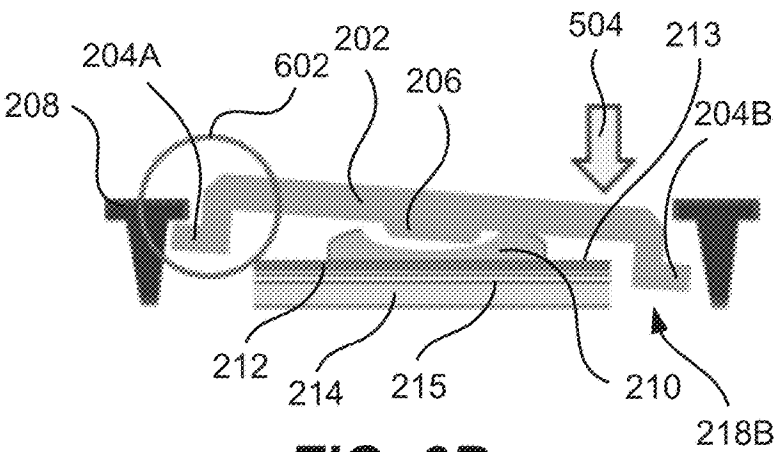

Details of the operation of the key 200 when the key 200 is in a depressed state is illustrated in FIGS. 6A-6C. Specifically, FIG. 6A illustrates the operation of the key 200 when the key 200 is subjected to a force at the center 502 of the keycap 202. FIGS. 6B and 6C illustrate the operation of the key 200 when the key 200 is subject to a force at the right edge 504 and the left edge 506 of the keycap 202, respectively.

As illustrated in FIG. 6A, when a downward force 502 is applied at the center of the keycap 202, the keycap 202 may depress and the protrusion 206 may compress the compressible dome structure 210. In embodiments, the tabs 204A and 204B may press into openings 218A and 218B, respectively, of the membrane 212 and/or the plate 214. As such, the tabs 204A and 204B may extend below a top surface 213 of the membrane 212 during effectuation of a key press. In some embodiments, the tabs 204A and 204B may extend below a top surface 215 of the plate 214. Accordingly, the tabs 204A and 204B may not contact a bottom surface of the keyframe 208 when the key 200 is depressed. Although tabs 204C and 204D are not illustrated, one skilled in the art would understand that operation of tabs 204A and 204B are applicable to tabs 204C and 204D as well.

FIG. 6B illustrates the operation of the key 200 when downward force 504 is applied to an edge of the keycap 202. According to embodiments of the present invention, the magnitude of force 504 applied at the edge of the keycap 202 to effectuate a key press may be the same magnitude of force necessary to effectuate a key press at the center 502 of the keycap 202. As an example, when downward force 504 is applied to the edge of keycap 202, a corresponding tab disposed below that edge, e.g., tab 204B, may be pressed down into a corresponding opening directly below the tab, e.g., opening 218B. In certain embodiments, the tab 204B is pressed below the top surface 213 of the membrane 212. Additionally, in embodiments, the tab 204B is further pressed below the top surface 215 of the plate 214. In response to the downward movement of the tab 204B, a tab on the opposite side of the keycap 202, e.g., tab 204A, may rise upward against a bottom surface of the keyframe 208, as shown in the region 602. Accordingly, the tab 204A may not be disposed below the top surface 213 of the membrane 212 while the tab 204 is disposed below the top surface 213. The keyframe 208 may prevent further upward vertical movement of the tab 204A when the key 200 is in the depressed state. This counteracting movement enables the keycap 202 to tilt in place such that the protrusion 206 depresses the compressible dome structure 210 with a substantially same amount of force required to depress the key 200 at the center of the keycap 202, i.e., force arrow 502.

Similar to FIG. 6B, FIG. 6C illustrates the operation of the key 200 when downward force 506 is applied to an opposite edge of the keycap 202. As downward force 506 is applied to the opposite edge, a similar counteracting movement occurs, thereby depressing the compressible dome structure 210 with the protrusion 206 to effectuate a key press. More specifically, the tab 204A may press into the respective opening 218A past the top surface 215 of the plate 214, and the tab 204B may press upward against the bottom surface of the keyframe 208. The magnitude of force 506 required to effectuate a key press may be the same as the amount of force required at the center and the opposite edge, as discussed herein with respect to FIGS. 6A and 6B, respectively. Thus, according to embodiments of the present invention, the key 200 enables effectuation of a key press with a same amount of force regardless of where the force is applied on the keycap 202.

The magnitude of force required to effectuate a key press may be determined based upon ergonomics. For instance, the magnitude of force may be one that is comfortable for a user to apply while minimizing accidental effectuation of a key press. In embodiments, the magnitude of force required to effectuate a key press ranges between 40 to 80 gram force (gf). In specific embodiments, the magnitude of force required to effectuate a key press is approximately 60 gf.

Forming an Input Device Having the Keyframe Module

Figure 7A:
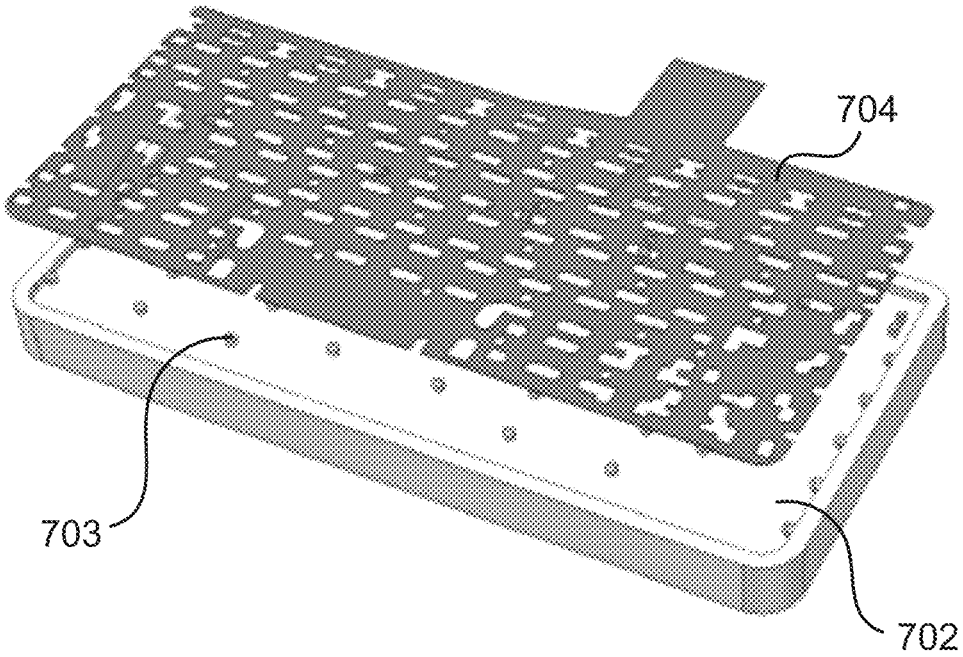
FIGS. 7A-7B are simplified diagrams illustrating top perspective views of a method of forming a subassembly, in accordance with certain embodiments of the present invention.

FIGS. 7A-8F illustrate a method of forming an input device having an array of keyframe modules, e.g. keys 200, according to embodiments of the present invention. Specifically, FIGS. 7A-7B illustrate a method of forming a subassembly for integrating into the input device, and FIGS. 8A-8F illustrate a method of forming the input device. FIGS. 7A-8F illustrate the input device as a keyboard having an array of keys, however embodiments of the present invention are not limited to such input devices. For instance, embodiments discussed herein may apply to any input device having a depressible button or key.

A subassembly may be an assembly formed of more than one layer that is incorporated into another assembly. For instance, a subassembly, according to embodiments of the present invention, may be formed of a membrane and a dome sheet that may be incorporated into a keyboard. As illustrated in FIG. 7A, a membrane 704 may be placed onto a subassembly positioning fixture 702. In embodiments, the subassembly positioning fixture 702 may be a rigid, supporting structure with features 703 that complement the features of the membrane 704. Thus, when the membrane 704 is placed upon the subassembly positioning fixture 702, the membrane 704 may be aligned with the subassembly positioning fixture 702.

Once the membrane 704 is placed on the subassembly positioning fixture 702, a dome sheet 706 may be placed on the membrane 704. In certain embodiments, the features 703 on the subassembly positioning fixture 702 help align the dome sheet 706 with the membrane 704. When aligned, the dome sheet 706 may be electrically coupled to the membrane 704. The dome sheet 706 may include an array of dome structures 708, which may be similar to the compressible dome structures 206 discussed herein with respect to FIG. 2. In some embodiments, the dome sheet 706 is adhered to the membrane 704 by any suitable adhesive. The adhesive may be initially disposed on the dome sheet 706 to attach the dome sheet 706 to the membrane 704 when the dome sheet 706 is placed on the membrane 704. After the dome sheet 706 is attached to the membrane 704, the subassembly is formed and may be removed by pulling the subassembly off of the subassembly positioning fixture 702.

Figure 8A:
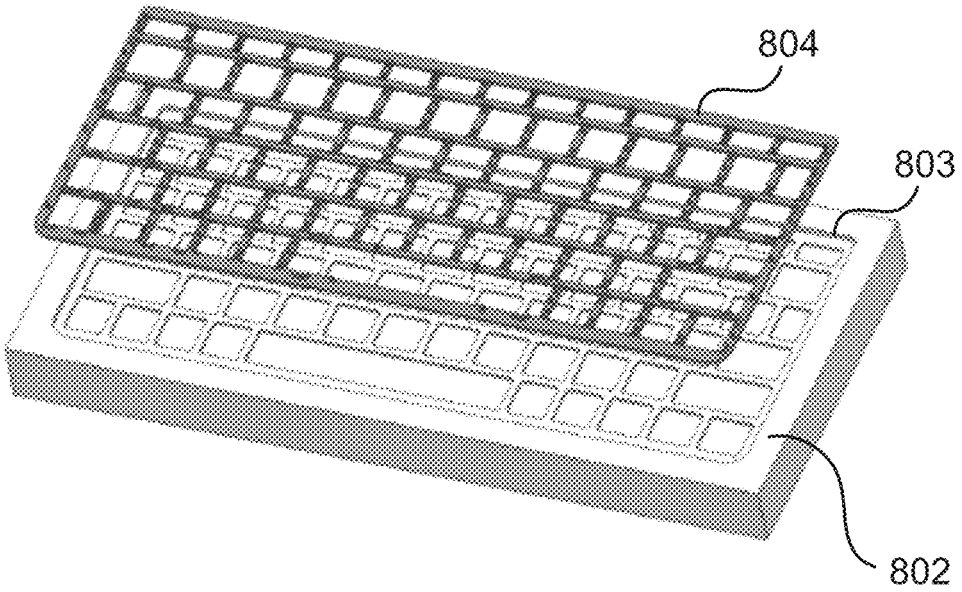
FIGS. 8A-8F are simplified diagrams illustrating top perspective views of a method of forming an input device, in accordance with certain embodiments of the present invention.
Figure 8B:
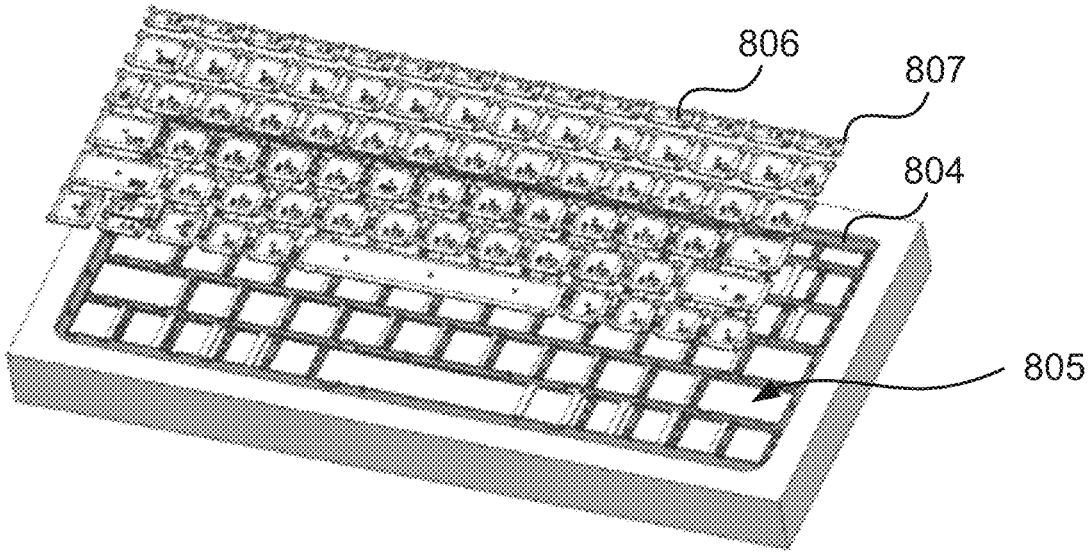
Figure 8C:
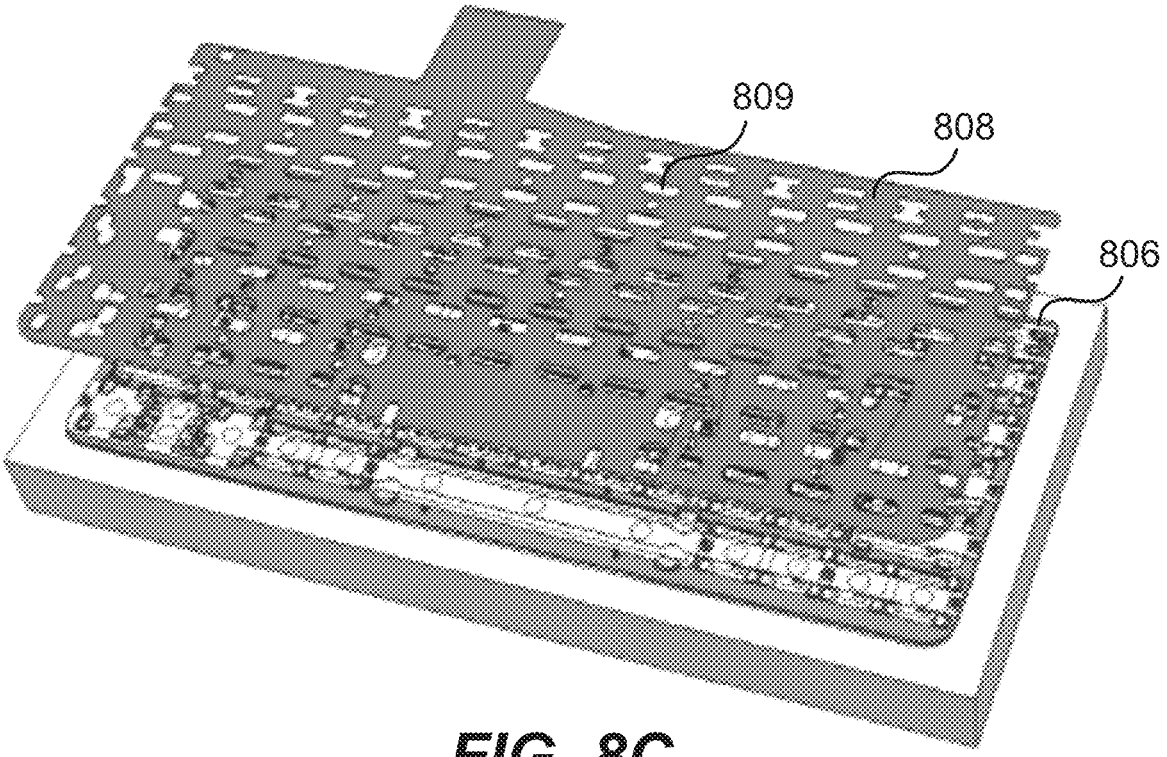

The subassembly may be used to form the input device, as explained in FIGS. 8A-8F herein. In FIG. 8A, a keyframe 804 may be placed on a keyboard positioning fixture 802. In embodiments, the keyboard positioning fixture 802 may be a supporting structure with features 803 that complement the features of the keyframe 804. Thus, when the keyframe 804 is placed upon the keyboard positioning fixture 802, the keyframe 804 is aligned with the keyboard positioning fixture 802.

After placing the keyframe 804 onto the keyboard positioning fixture 802, an array of keycaps 806 may be placed on the keyframe 804. Specifically, the array of keycaps 806 may be placed in an array of key openings 805 disposed in the keyframe 804. In embodiments, each keycap 806 may have a top surface that is placed downward into the key openings 805 so that tabs 807, such as tabs 204 in FIG. 2, of the keycaps 806 may rest upon portions of the keyframe 804. The top surface of the keycaps 806 may make contact with respective features of the keyboard positioning fixture 802.

Figure 7B:
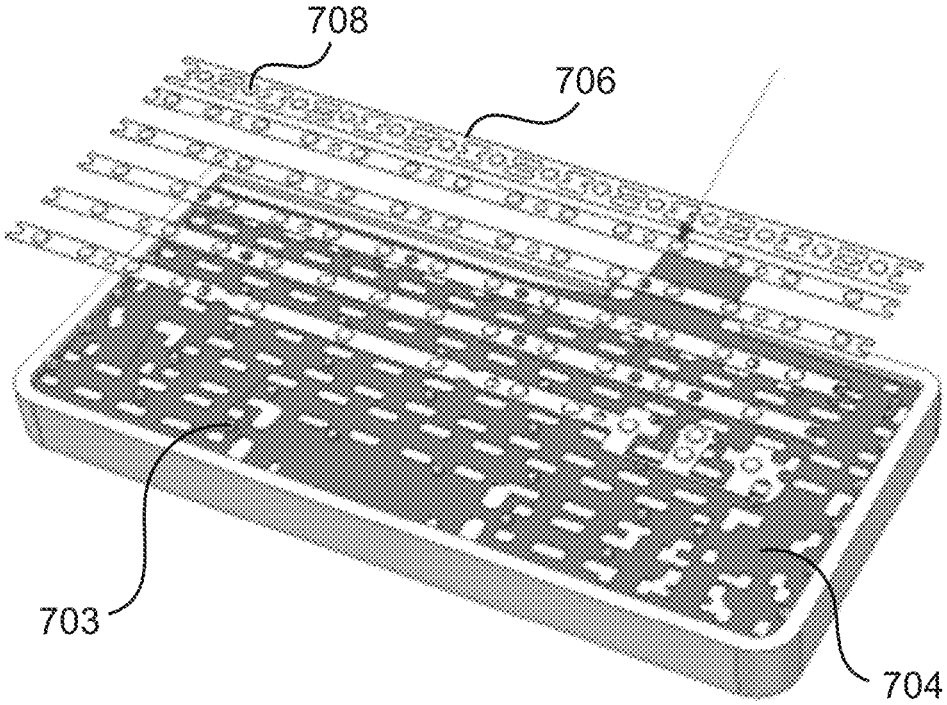

Once the array of keycaps 806 are placed on the keyframe 804, a subassembly 808, such as the subassembly formed in FIGS. 7A-7B, which includes the membrane 704 and the dome sheet 706, may be placed upon the keycaps 806. In embodiments, the subassembly 808 may be placed on the keycaps 806 with the domes 708 facing down. The subassembly 808 may include a plurality of openings 809 that correspond to the tabs 807. For instance, the plurality of openings 809 may be positioned above the tabs 807 when the subassembly 808 is aligned with the keycaps 806. In embodiments, the openings 809 are similar to the openings 218 discussed herein with respect to FIGS. 2 and 3.

Figure 8D:
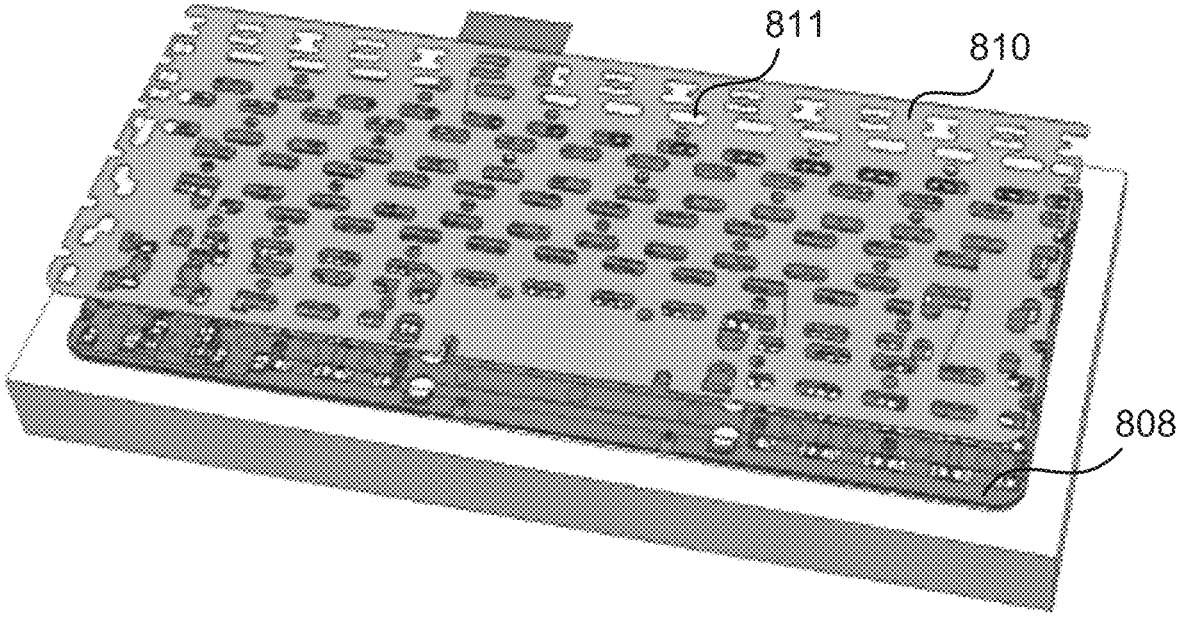
Figure 8E:
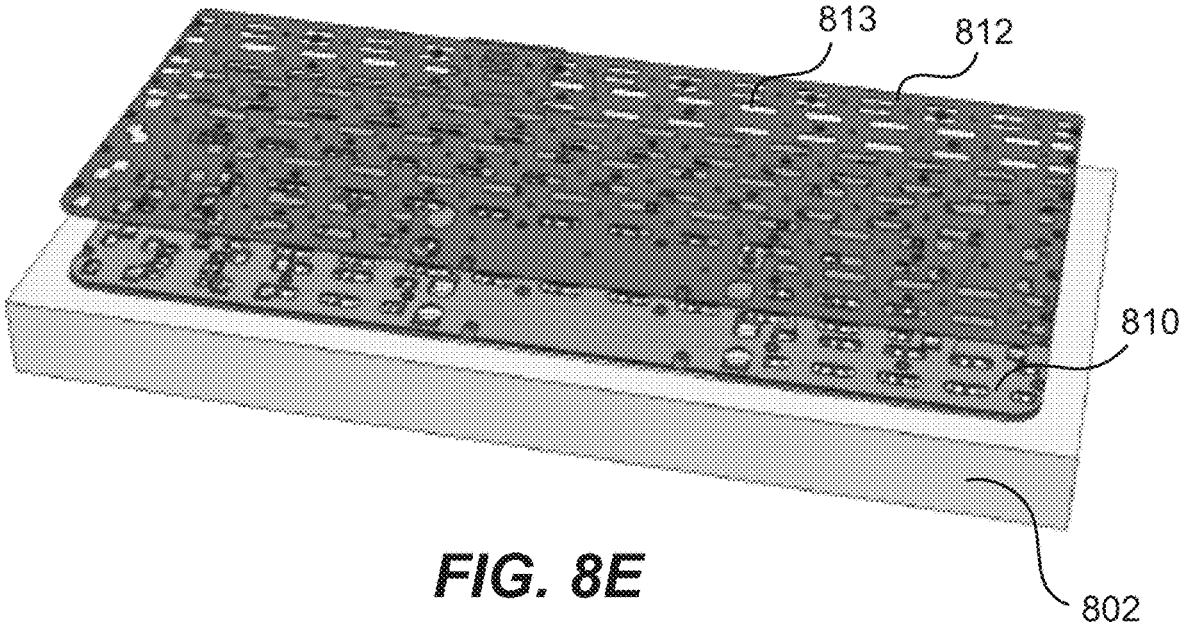

An insulating film 810 may then be placed on the subassembly 808 as illustrated in FIG. 8D. The insulating film 810 may be a soundproofing film that minimizes audible noise when the keyboard is being used. The insulating film 810 may have openings 811 that correspond to the openings 809 of the subassembly 808. Similar to the openings 809, the openings 811 may be positioned above the tabs 807 when the insulating film 810 is aligned with the subassembly 808. In certain embodiments, the insulating film 810 is formed of TPU.

After the insulating film 810 is placed on the subassembly 808, a plate 812 may be placed on the insulating film 810. The plate 812 may be a rigid structure that structurally supports the keyboard when the keyboard is separated from the keyboard positioning fixture 802. When in place, the plate 812 may be coupled to the keyframe 804, thereby forming an input device structure, e.g., a keyboard. The plate 812 may be coupled to the keyframe 804 by heat treatment to secure the plate 812 to the keyframe 804. In embodiments, the plate 812 is formed of any suitable rigid material, such as a metal. In a particular embodiment, the plate 812 is formed of aluminum.

Figure 8F:
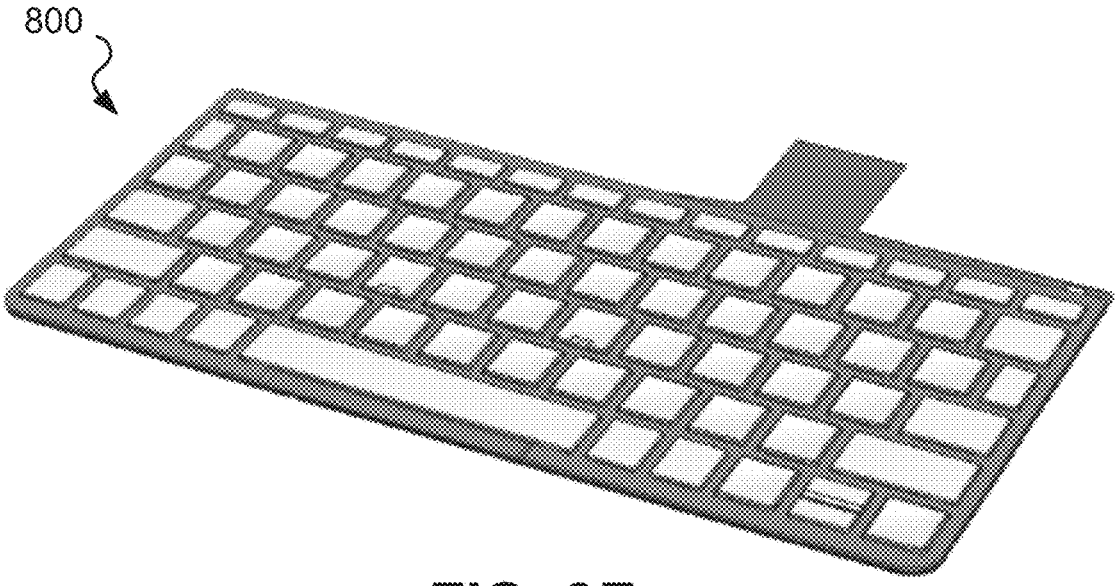

Once the plate 812 is secured and coupled to the keyframe 804, the keyboard 800 is complete and may be removed from the keyboard positioning fixture 802 by pulling the keyboard 800 away from the fixture 802, as shown in FIG. 8F. According to the method described herein with respect to FIGS. 8A-8F, some similarities are shared with the embodiment illustrated in FIG. 2, including the membrane 704, compressible dome 708, keyframe 804, array of keycaps 806, insulating film 810, and plate 812.

Figure 9:
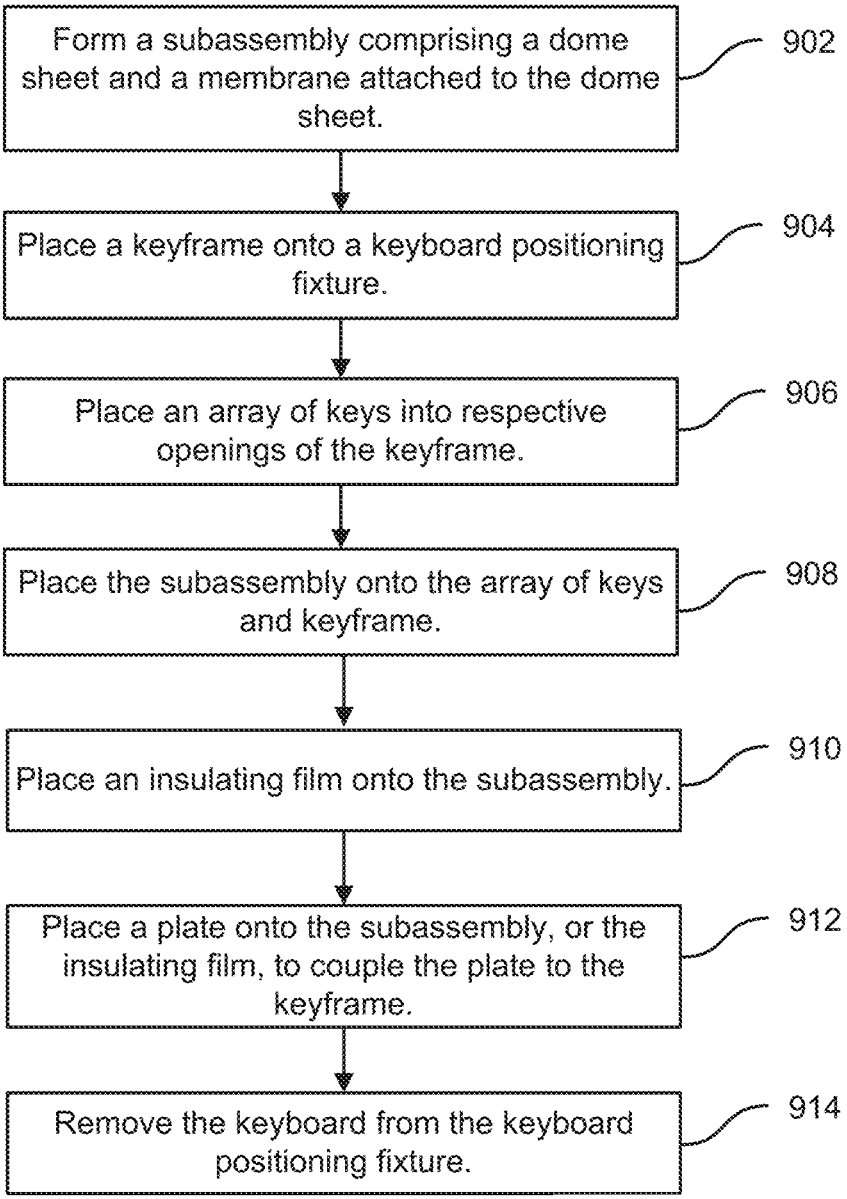
FIG. 9 is a flow diagram of a method of forming an input device, in accordance with certain embodiments of the present invention.

FIG. 9 illustrates a flow chart describing the method of forming an input device according to embodiments of the present invention. At block 902, a subassembly comprising the dome sheet and a membrane attached to the dome sheet is formed. At block 904, a keyframe may be placed onto a keyboard positioning fixture. The keyboard positioning fixture may include features that help align the keyframe to the keyboard positioning fixture and subsequent structures to the keyframe. At block 906, an array of keys may be placed into respective openings of the keyframe. At block 908, the subassembly may be placed onto the array of keys and keyframe. The subassembly may be placed such that the domes are facing downward into the keyboard positioning fixture. At block 910, an insulating film may optionally be placed onto the subassembly. At block 912, a plate may be placed onto the subassembly, or the insulating film, to couple the plate to the keyframe. The plate may be coupled by a heat treatment. Following coupling of the plate, a keyboard may be formed. At block 914, the keyboard may be removed from the keyboard positioning fixture.

It should be appreciated that the specific steps illustrated in FIG. 9 provide particular methods according to some embodiments. Other sequences of steps may also be performed according to alternative embodiments. For example, alternative embodiments may perform the steps outlined above in a different order. In one such example, block 902 may be performed after block 906 and before 908, such that the subassembly is formed immediately before it is placed on the array of keys and keyframe. Moreover, the individual steps illustrated in FIG. 9 may include multiple sub-steps that may be performed in various sequences. Furthermore, additional steps may be added or removed depending on the particular application.

The above description illustrates various embodiments of the present invention along with examples of how aspects of the present invention may be implemented. The above examples and embodiments should not be deemed to be the only embodiments, and are presented to illustrate the flexibility and advantages of the present invention as defined by the following claims. For example, although certain embodiments have been described with respect to particular process flows and steps, it should be apparent to those skilled in the art that the scope of the present invention is not strictly limited to the described flows and steps. Steps described as sequential may be executed in parallel, order of steps may be varied, and steps may be modified, combined, added, or omitted. Further, although the description uses words to describe certain structures, such as "protrusion," "plate," "dome," etc., it is to be appreciated that any other suitable word that has the same or similar meaning within the scope of the present invention are envisioned herein as well.

The specification and drawings are, accordingly, to be regarded in an illustrative rather than restrictive sense. Other arrangements, embodiments, implementations and equivalents will be evident to those skilled in the art and may be employed without departing from the spirit and scope of the invention as set forth in the following claims.

What is claimed is:

1. An input device comprising:

a keyframe having a key opening, wherein the keyframe is configured to receive a key within the key opening, the key having a plurality of tabs that extend laterally from a bottom surface of the key; and a plate coupled to the keyframe, the plate having a top surface and an opening disposed therein, wherein a location of the opening within the plate is in alignment with a location of the plurality of tabs of the key such that one or more of the plurality of tabs pass through the opening within the plate and below a top surface of the plate in response to a depression of the key, and wherein the opening and the location of the plurality of tabs are vertically aligned along a path defined by the depression of the key.

2. The input device of claim 1 further comprising:

a compressible dome structure coupled to the keyframe and configured to be positioned underneath a protrusion that extends at an angle normal from a bottom surface of the key, wherein the protrusion rests on the compressible dome structure, and wherein the protrusion depresses the compressible dome structure in response to the depression of the key.

3. The input device of claim 2 wherein the compressible dome makes contact with the protrusion when the key is in a non-depressed state.

4. The input device of claim 2 wherein the compressible dome structure contacts the protrusion and causes the plurality of tabs to press up against a bottom of the keyframe when the key is in a non-depressed state.

5. The input device of claim 2 wherein the compressible dome structure is coupled to the plate.

6. The input device of claim 2 further comprising a membrane disposed between the plate and the compressible dome structure.

7. The input device of claim 6 wherein the membrane is electrically coupled to the compressible dome structure.

8. The input device of claim 7 wherein the membrane comprises a plurality of electrical routing lines to electrically couple the compressible dome structure with an external device.

9. The input device of claim 2 wherein the compressible dome structure is formed of a metal.

10. The input device of claim 1 wherein a portion of the keyframe makes contact with the plurality of tabs to prevent further upward vertical movement of the plurality of tabs.

11. The input device of claim 1 wherein the plurality of tabs are disposed at corners of the key.

12. The input device of claim 1 wherein the plurality of tabs and the key form one monolithic structure.

13. The input device of claim 1 wherein a substantially same amount of force is required to depress the key when the key is tilted versus when the key is not tilted.

14. The input device of claim 1 wherein the plurality of openings prevent further upward vertical movement of the plurality of tabs.

15. A method of forming a keyboard comprising:

placing an array of keys into respective openings of a keyframe, each of the keys of the array of keys including a plurality of tabs on a corresponding bottom surface;

coupling a plate to the keyframe, the plate having a top surface, wherein the plate comprises a plurality of openings, wherein a location of the plurality of openings are in alignment with a location of the plurality of tabs such that one or more of the plurality of tabs for each of the array of keys pass through one or more of the plurality of openings within the plate and below a top surface of the plate in response to a depression of a key of the array of keys when the key is in a depressed state; and wherein the plurality of openings and the location of the plurality of tabs are vertically aligned along a path defined by the depression of the key.

16. The method of claim 15 wherein a substantially same amount of force is required to depress the key when the key is tilted and when the key is not tilted.

17. The method of claim 15 wherein the plurality of openings prevent further upward vertical movement of the tabs.

* * * * *